US007896255B2

(12) United States Patent
Frenzel

(10) Patent No.: US 7,896,255 B2
(45) Date of Patent: Mar. 1, 2011

(54) PARTLY FOAMED RAILROAD TRACK SUPPORT ARRANGEMENT

(75) Inventor: Tim Frenzel, Brunkensen (DE)

(73) Assignee: MSB-Management GmbH, Freden (Leine) (DE)

( * ) Notice: Subject to any disclaimer, the term of this patent is extended or adjusted under 35 U.S.C. 154(b) by 262 days.

(21) Appl. No.: 11/655,046

(22) Filed: Jan. 18, 2007

(65) Prior Publication Data

US 2008/0173724 A1 Jul. 24, 2008

(51) Int. Cl.
*E01B 1/00* (2006.01)

(52) U.S. Cl. ..... 238/2

(58) Field of Classification Search ..... 238/2, 3, 238/6, 8, 9, 283, 382
See application file for complete search history.

(56) References Cited

U.S. PATENT DOCUMENTS

| | | | | |
|---|---|---|---|---|
| 3,656,690 | A | 4/1972 | Hanig | |
| 3,869,988 | A * | 3/1975 | Unbehaun et al. | 104/11 |
| 3,939,774 | A | 2/1976 | Theurer et al. | |
| 3,942,448 | A | 3/1976 | Unbehaun et al. | |
| 4,235,371 | A * | 11/1980 | Kohler | 238/382 |
| 4,311,273 | A * | 1/1982 | Marsh | 238/1 |
| 4,406,403 | A * | 9/1983 | Luebke | 238/2 |
| 5,487,501 | A * | 1/1996 | Engst et al. | 238/2 |
| 6,283,383 | B1 * | 9/2001 | Blank et al. | 238/382 |

FOREIGN PATENT DOCUMENTS

| | | |
|---|---|---|
| DE | 86 201 | 11/1970 |
| DE | 2 063 727 | 8/1972 |
| DE | 7319950 U | 9/1973 |
| DE | 2 305 536 | 8/1974 |
| DE | 24 48 978 | 7/1975 |
| DE | 43 15 215 | 11/1993 |
| EP | 0 569 867 | 11/1993 |
| EP | 1 149 950 | * 10/2001 |
| EP | 1 298 252 | 4/2003 |
| EP | 1 619 305 | 1/2006 |
| GB | 2 356 880 | 6/2001 |
| WO | WO 94/28247 | 12/1994 |
| WO | WO 9428247 | * 12/1994 |

OTHER PUBLICATIONS

Translation of DE20637727, publication date Aug. 1972, 2 pages.*
European Search Report dated Aug. 2, 2006, for European Application No. EP 05 10 6393, 2 pgs.
U.S. Appl. No. 12/278,676, filed Feb. 12, 2007, Tim Frenzel.

* cited by examiner

*Primary Examiner* — Mark T Le
(74) *Attorney, Agent, or Firm* — Shumaker & Sieffert, P.A.

(57) ABSTRACT

A track superstructure for a railway on a subgrade inclined transversely to the length thereof, comprises a ballast structure of individual ballast stones, and sleepers embedded in the ballast structure, on which rails may be mounted, the ballast structure comprising load dissipation regions beneath the sleepers, the regions receiving loads acting vertically on the ballast structure via the sleepers when a train rides on the rails and transferring these loads to the subgrade below the ballast structure. This transfer is characterized in that substantially only the voids between the ballast stones within the load dissipation regions of the ballast structure are filled with a foam material, especially a PU polyurethane foam material, for fixing the ballast stones in a stable position, and an elastic drain layer is arranged between the ballast structure and the subgrade.

20 Claims, 3 Drawing Sheets

PARTLY FOAMED RAILROAD TRACK SUPPORT ARRANGEMENT

Figure 1:
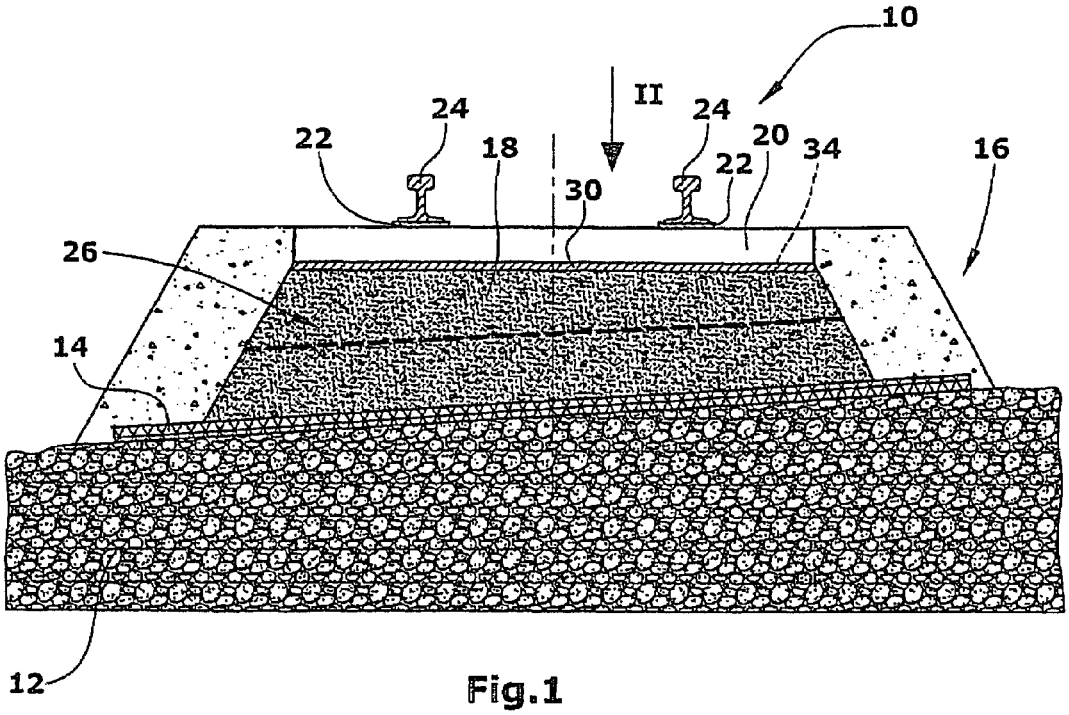

Among the traditional and most frequently used track systems today are ballasted tracks, optionally equipped with wooden, concrete or steel sleepers. This track structure has been optimized continuously from the beginnings of railroad traffic by practical use and theoretic backcalculation.

To obtain an economically feasible track system, the durability of the main components—rails, sleepers, ballast and the subbase—have to be properly matched. Low life cycle costs will be incurred if the subbase has a longer useful life than the ballast bed and the ballast bed has to be renewed only when the sleepers have reached the end of their useful life. During the last decades, the strong increase in load by more trains, higher loads per axle and velocities, as well as heavy rolling stock have had the result that, for economic reasons, the track unit was reinforced first by using more rigid rail profiles and concrete sleepers. In a second phase, the subbase was improved where necessary by applying level protection layers and drainages in the course of a renewal of the track superstructure. Thus, the ballast bed factually became the weakest main element of the railroad track. The improvement of the ballast properties is an important measure for securing a sufficient useful life of the ballast bed made of stub stones which has a high pore volume in a clean state.

Presently, speeds up to more than 300 km/h are achieved (e.g. TGV) and heavy loads are transported on these tracks. The structure engineering has adapted to these structures and today has reached a high level worldwide.

From a theoretical point of view, the structure of a ballasted track is a complicated and complex task to realize. It is complicated because the ballast mass that is not a rigid, firm structure changes when dynamically influenced.

This means: When a track is laid, so-called tamping machines are used to compact the ballast after the track unit has been laid on a ballast bed of at least 30 cm in thickness. The track unit then rests on the ballast bed and transfers the loads from the passage of a train to the sleepers via the rails and from the sleepers on to the ballast bed. Ideally, the loads are then distributed in the ballast bed from stone to stone down the subjacent level and are then dissipated into the subbase.

Here, the purely static dissipation of the loads introduced is realized without any problems.

However, the changes in the structure of the ballast bed are caused by the dynamic load occurring during a train's passage.

As it is known, when a train passes, positive and negative loads are introduced. This means that perpendicular loads and, additionally, relieving leading and hunting waves are applied to the track. In combination with the dynamic frequency of the train's running the "stone-on-stone structure" may thus change. The ballast stones turn, becoming round in the end, and the position of the track changes. If this were an entirely uniform process, no disadvantage would result therefrom for the track system. However, this is not the case due to the routing of the track—bends, straight parts, bridges, different substrates, etc. In intervals, the ballast has to be compacted again with tamping machines, so as to preserve a good track position for a longer period.

Today, freight trains run with a load of 22.5 t per axle. This load is transferred from the bottom of the sleepers to an average of about 330 ballast stone tips, from where it is passed downward from stone to stone. Thus, only 12% of the base area of the sleeper are used as the footprint. These values hold for both horizontal and vertical load dissipation. The void volume in the ballast structure is about 40%, i.e. there is ample space to allow for a turning or displacement of individual ballast stones upon dynamic load.

In the past, different methods have been developed to counteract this problem:

1. Track systems without ballast, so-called "fixed railroads", have been and are developed. These may have a subbase of concrete or of asphalt.
2. After the track has been finally compacted, the ballast structure is cast with a cement-like mixture, thus becoming rigid.
3. After the track has been finally compacted, the ballast structure is treated with a liquid plastic material, whereby the stones are adhered pointwise at the contact points between the stones.

A variety of past approaches is known that attempt to alter the characteristics of technical structures, for example to enhance stability by an effective "hold" of the stones.

From DD 86 201 and DE 24 48 978 A1, for example, a full or partial bonding of all ballast stones of the ballasts structure is known. This causes draining problems, since surface water can no longer penetrate the ballast structure in the vertical or the horizontal direction, which is particularly disadvantageous with lines of two or more tracks and especially in bend areas.

A full bonding of all ballast stones is also known from DE 20 63 727, using a bonding material, possibly adapted to be foamed. A machine with which this full bonding can be achieved is described in U.S. Pat. No. 3,942,448 and DE-U-7319950, respectively.

From DE-A-23 05 536, a method for lifting tracks is known, wherein a swelling material is introduced into the track body through the rails for the purpose of lifting the track body.

The present invention intends to take an alternative path to the stabilization of the ballast structure without influencing its morphology and with consideration to the problems of draining.

The invention proposes a track superstructure for a railroad on a subgrade inclined transverse to the length thereof, which is provided with a ballast structure of individual ballast stones, and sleepers embedded in the ballast structure, on which rails may be mounted, the ballast structure comprising load dissipation regions beneath the sleepers, said regions receiving loads acting vertically on the ballast structure via said sleepers when a train rides on the rails and transferring these loads to the subgrade below the ballast structure.

In this track superstructure provided according to the invention, substantially only the voids between the ballast stones within the load dissipation regions of the ballast structure are filled with a foam material, especially a PU foam material, for fixing the same in a stable position, and an elastic drain layer is arranged between the ballast structure and the subgrade.

The idea of the invention is that the ballast structure is filled only partly with a foam material, however, within the above-mentioned regions, the voids between the ballast stones are substantially completely filled with this foam material, it being guaranteed that the track system morphology remaining unaltered by the foaming as compared to the state of the ballast structure before the introduction of the foam material. These regions of the ballast structure are the load dissipation regions beneath the sleepers, these load dissipation regions extending obliquely sideward from the sleepers and below the sleepers. By this partial foaming of the ballast structure, as provided by the invention, the voids between the ballast stones within the zones of the ballast structure between the load dissipation regions remain free so that surface water can flow away downward or, within these zones, to the sides. Surface water reaching the ballast structure from the sides can also pass through the ballast structure in the horizontal direction.

Due to the present partial foaming of the ballast structure, it is just those ballast stones that are most "loaded" during a train's passing over the track that remain in a stable position. Thus, they permanently maintain the position assumed after the compacting and the (artificial) first subsiding of the track superstructure, and they do so substantially for the entire service life of the track superstructure. A subsequent compacting, as it is required today for track ballast structures, can be omitted.

A foam useful with the present invention is a rigid foam or a semi-rigid foam, i.e. a foam that mounts considerable resistance against deformation. The foam must have a sufficient pressure resistance. The foam may be adjusted with respect to pressure resistance, reaction times, reaction components, and pot life. Useful foam materials are, among others, polyurethane (PU), polyester (PES), polystyrene (PS) or polyvinyl chloride (PVC) foams. The foam may be closed-cell or open-cell foam. Open-cell foams are advantageous in that they are acoustically effective, which is favorable in track structure applications. The foam should be elastic, of long-term stability, resistant to degradation, fire-resistant, resistant to vermin and to chemicals.

To provide a possibility for draining below the track superstructure, the ballast structure is arranged on an elastic drainage layer. Here, drain mats known for drainage purposes may be used, such mats being supplied, for example, by Rehau AG. Porous rubber mats or mats of another elastomer material are advantageous. Elastomer granulates are particularly useful, whose particles are interconnected while leaving voids extending horizontally and vertically through the mats. For example, particles of recycled tires are suited for making such elastic drain mats. An elastic elastomeric drain mat can receive high weights and contact forces, is stable over extended periods and resistant to degradation, and also has the other properties mentioned above that preferably apply to the foam.

Up to the present, drain mats could not be used under ballast structures, since they cannot withstand the loads that occur over time and are caused by several compacting operations. According to the invention, however, only a single compacting operation is required, namely when making the track superstructure. In this respect, it is another merit of the invention to have been successful in providing a draining material under the track superstructure due to the elimination of subsequent compacting operations. The drainage causes a controlled and directed discharge of water that effectively prevents an erosion of the subgrade (ground level). Further, as described above, the material of the drain mat contributes to the long-term stability thereof, whereby it maintains its (horizontal) porosity even under high pressure loads.

For a further fixation of the ballast stones within the load dissipation regions, it is feasible to provide the bottom faces of the sleepers with an elastic material, especially a plastic material (so-called sleeper footing). Such sleepers with footings are found in EP-A-1 298 252, for example. The ballast stones contacting the sleeper penetrate into the elastic material of the sleeper footing, whereby a fixation similar to a "catch connection" is obtained.

The invention further provides a method for making a track superstructure for a railway on a subgrade inclined transverse to the length thereof, wherein an elastic drain mat is arranged on the subgrade, a ballast structure of individual ballast stones having voids between them is formed on the drain mat, sleepers are embedded into the ballast structure, rails are fastened on the sleepers, and a foamable material is introduced into the voids between the ballast stones to fix the stones in a stable position, the foamable material being introduced into the voids between ballast stones substantially present within load dissipation regions of the ballast structure beneath the sleepers.

It is advantageous for the chemical reaction during the forming of the foam if the ballast structure is heated or is at an elevated temperature before introducing the foamable material, which, depending on the ambient conditions, may be achieved even without heating by an additional heat source.

Further, as already stated before, sleepers with a footing of an elastic material, especially plastic material, are embedded in the ballast structure.

Suitably, the known steps of compacting and/or causing a first subsiding by vibrating the ballast structure are performed prior to the inventive step of partly foaming the ballast structure, in which the same is filled with foam exclusively in the load dissipation regions.

The main problem of the known ballasted track—the turning of the stones under dynamic load—is thus prevented, according to the invention, by foaming the stones in the ballast bed with a foam material only in the load dissipation regions after the new or renewed track has been finished.

This means that all voids between the ballast stones beneath the sleeper and in the adjacent load dissipation regions are closed by the foam to be introduced into the ballast structure; the voids between the sleepers and outside the load dissipation regions remain free, thus serving to discharge surface water. The foam is adjusted such that it is flexible. The introduction of the foam and the forming thereof in the ballast structure does not alter the morphology of the ballast structure.

The foam of choice is a PU foam. PU foams have been known for decades in industry and construction. Their adaptation to the respective application poses no problems. Their use in humid weather is not detrimental but rather beneficial.

All ballast stones of the track within the load dissipation regions are bonded by the introduced foam to form a unitary ballast structure. The adhesion of the foam to the ballast stones and the density of the structure of the foam can be adapted to the magnitude of the maximum load introduced with a coefficient of safety added.

After the foam has cured, all forces introduced by a train riding thereover can be transferred via this homogenous structure, i.e. through the ballast stones and not through the foam that serves to fix the ballast stones in a stable position.

Since the foam is composed of a plurality of pores, no rigid ballast structure is obtained by closing the voids. Rather, a structure with an infinite number of "shock absorbers" is formed. Thereby, an acoustic insulation is obtained in addition.

The PU foam introduced improves the track system in many ways:

the subgrade beneath the ballast is protected from frost by the high insulating capacity of the air micro-voids in the PU foam.

the subgrade beneath the ballast is protected from water.

the risk of a distortion of the track in the horizontal or vertical direction is reduced, since higher forces can be received.

the resistance of a track to transverse dislocation is increased.

the dynamic load on the subgrade and the vicinity is reduced.

the calculation methods regarding the positional stability of a track can be optimized.

the ballast structure has an acoustically insulating effect (reduced transfer of vibrations from the track system both via the ground and the air).

The requirements of the present method and the ballast structure, respectively, are as follows:

1. washed ballast stones
2. tracks, compacted and approved under railroad engineering aspects
3. track ballast cross section thermally prepared—temperature parameter
4. curing times and flexibility of the foam can be influenced
5. absolute full foaming of the respective load dissipation zones (angle of approx. 60°) beneath the sleepers
6. recyclability according to KrW/AsfG
7. compliance with requirements as to shear resistance, tear resistance and spring stiffness of the foam depending on the respective application.

The track system of the present invention is built as follows:

1. After having finished the subgrade level and prior to applying the track laying ballast, an elastic drain mat (e.g. Securdrän®, available from Naue-Fasertechnik GmbH & Co. KG) is placed on the surface of the PSS (level protection layer) beneath the footprint of the ballast. It is thus guaranteed that in lines with two or more tracks the drainage of the center is permanently secured. In one-track lines, this can be omitted; a drainage of the edge zone that is higher due to the inclination of the level is obtained (this is also true for multi-track lines).
2. The bottom faces of the concrete or steel sleepers to be built in are preferably provided with a footing of plastic material according to prior art (e.g. EP-A-1 298 252). Thus, upon compacting, the ballast stones are wedged into the structure of the plastic material and retained there.
3. The track built and compacted using the tamping machine is treated additionally with a track stabilizer of known construction. Thereby, first subsidings otherwise caused by the train load to be expected are anticipated. The track system is now in a state for approval under railroad engineering regulations.
4. The track is foamed beneath the sleepers and in the adjacent regions of pressure dissipation in the ballast structure. To this end, the ballast structure is advantageously thermally treated and cleaned (washed ballast stones) before.

The present invention does not assume that loads from train operation are transferred or dissipated by the foam. The built-in foam stabilizes the ballast structure and prevents the ballast core from becoming displaced from the ballast structure that was made and compacted with the tamping machine. The approved quality of the veritably stable ballasted track is maintained as built for a long time. In this respect, the durability of the foam (e.g. PU) and the composition thereof are of great importance.

As a rule, the technical behavior of particle-supported structures is not altered when foam (e.g. PU) is used. Only the properties of technical strength and rigidity are substantially enhanced. Moreover, PU foam also improves dynamic features regarding properties such as the insulating level and the velocity of the load pressure waves (e.g. compression wave, shear wave and surface wave).

When using a foam (e.g. PU), it is desirable to make sure that the reinforced and stabilized subbase functions on an acceptable level during its useful life. PU foam is preferably used in the proper spatial position and to the proper depth to guarantee that the improvements in the technical behavior are achieved. Moreover, PU foam is preferably built up chemically to be sure that its desired properties are appropriate for the respective application with consideration to rigidity, strength, viscosity, fatigue limits, acoustic insulation, temperature range, biochemical and hydroscopic properties, curing time and service life. The market offers freely available foams that can tolerate temperatures in a range from −30° to +80° C., are resistant to vapor and water, do not shrink or exert any dwell pressure, and are resistant to excrements (this should not be neglected, since many passenger wagons still have open toilet systems and thus discharge excrements onto the ballast). To achieve the desired behavior and a predictability, additional agents can be used in the PU foam to further extend the chemical properties. There are plenty of ready-mixed foams with corresponding properties that will be selected according to the given circumstances.

The invention provides a stabilized ballast superstructure in a railroad track made according to this method. Preferably, PU foam can be used to increase the vertical and/or longitudinal stability of the subbase (e.g. the rigidity and strength). The system should be controlled carefully to guarantee that the dynamic, vibratory or static loads and forces remain within the fatigue or load limits of the superstructure reinforced with PU foam, including a predefined safety factor and with consideration to the desired life cycles. Adding a PU foam causes a positive change in the static and dynamic behavior of the superstructure made of particles, thus also changing the overall and particular behavior of the subbase.

Types of ballast superstructures that are reinforced and stabilized by the previously described treatment method may also be used for:

a rapid stabilization of overloaded subbases until their final repair of the track section (e.g. removing slick and "wet spots" in a railroad track), vertical, lateral and longitudinal stabilization (in a track e.g. transition curves, high banks, to reduce maintenance efforts, for example), stabilization of tunnel tracks, reinforcement of bridge tracks, including the transitions before and behind bridges to prevent load surges, reducing the load on the track system by increased PU foam rigidity and strength properties, preventing induced plastic load on and attrition of the separation of particles (e.g. by splintering) by almost completely preventing the movement of the particles, reducing the occurrence of soiled particles, according to the invention, PU foam membrane can be employed (e.g. at contact sites between different subbase materials) to prevent the intrusion of dirt into the top ballast/railway ballast, supporting, in combination with the drain mat to be provided, the prevention of flow erosion of the surface and the subbases, allowing for an increase of applied loads and of the speed of vibrating loads without any significant increase in maintenance of the subbase, and reducing the damages to the subbase caused by the loads applied, reducing the generation and transmission of ambient noise, if desired, allowing for a low cost high-power cleaning (e.g. suction devices) of the reinforced superstructure to maintain tidiness (garbage, excrements, leafs, twigs, cigarette butts, etc.) by bonding the ballast surfaces between the sleepers with another (UV resistant) material in a single operation, improving the static and dynamic performance parameters of the superstructure and the subbase.

The composition of the foam is selected on the basis of the stiffness and strength properties required by the composite. Specifically, the tensile strength and shear strength properties are determined as a part of the construction process.

In areas with unfavorable geological formations, the foam properties (e.g. rigidity) are designed such that it can be guaranteed that an effective cushion-like foundation of stabilized ballast is built over the weak area. If the rigidity is high enough, a more uniform load distribution is achieved at the interface with the track system.

For track switches with a high maintenance effort, the foam properties are selected such that the strong vertical forces are distributed more effectively under the track switch, however, at the same time retaining good damping properties of the composite. A lifting of the sleeper by the introduction of the foam is substantially excluded.

When new tracks are laid, bores 20 may be provided during manufacture at different places in the sleepers 11 so that the foaming material can be directly injected into the underlying ballast, stabilizing the same completely.

To allow for a vertical/horizontal adjustability in newly laid tracks, commercially available rail fasteners (known as being mounted in "fixed tracks", for example) have to be provided and mounted to be able to later regulate a possible subsiding of the subgrade.

As is obvious from the description and the enclosed drawings, the track system comprises foamed ballast and ballast not foamed.

The foamed region is always located under the sleeper and in the load dissipation regions. This forms a cone-like foamed structure in the area of the sleeper.

Due to the two-track routing in straight line sections or in bends with the necessary track banks, the selected sparing foaming of the ballast bed forms regions in which the incidental precipitation can not be discharged in the usual manner as would be the case with a completely open ballast bed.

The selected embodiment including the plastic drain mat placed on the subgrade level addresses this problem.

In all instances, the precipitation will reach the plastic drain mats in the problematic zones, from where it is discharged outward in a controlled manner.

Due to the chosen placement over the entire surface under the sleepers, water leaves no traces of erosion on the subgrade and thus contributes to the protection of the subbase of the track.

Figure 2:
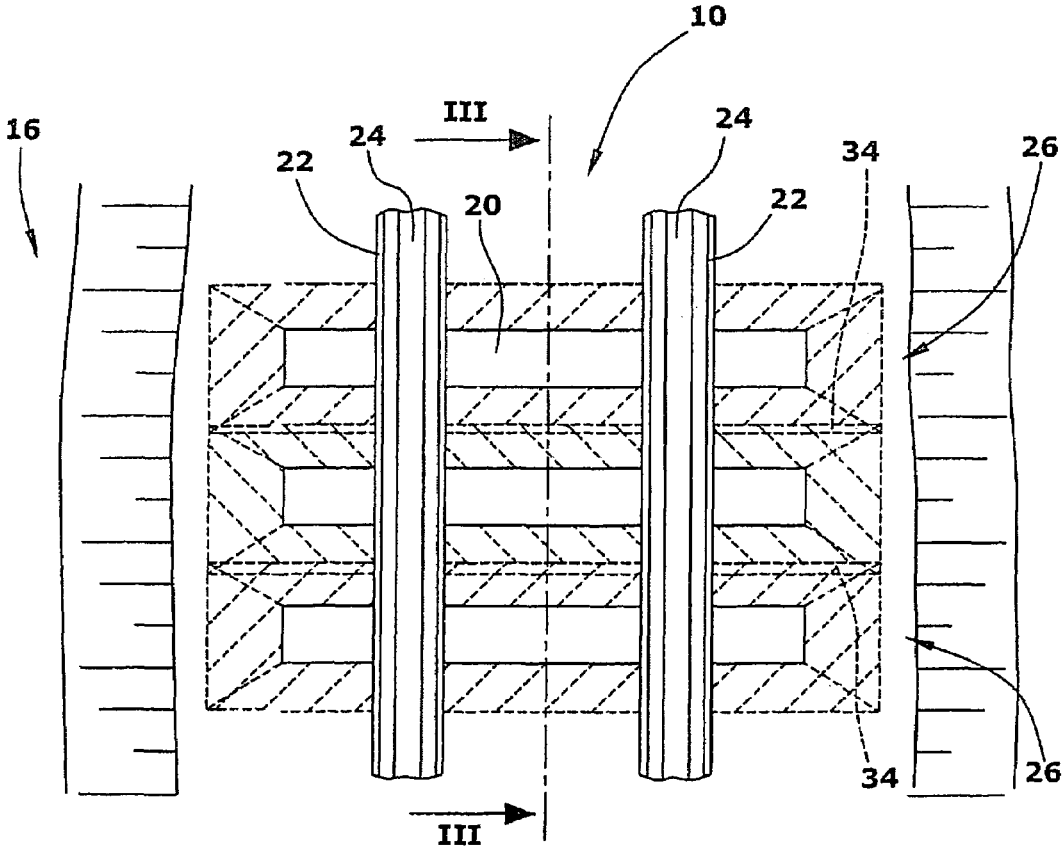
Figure 3:
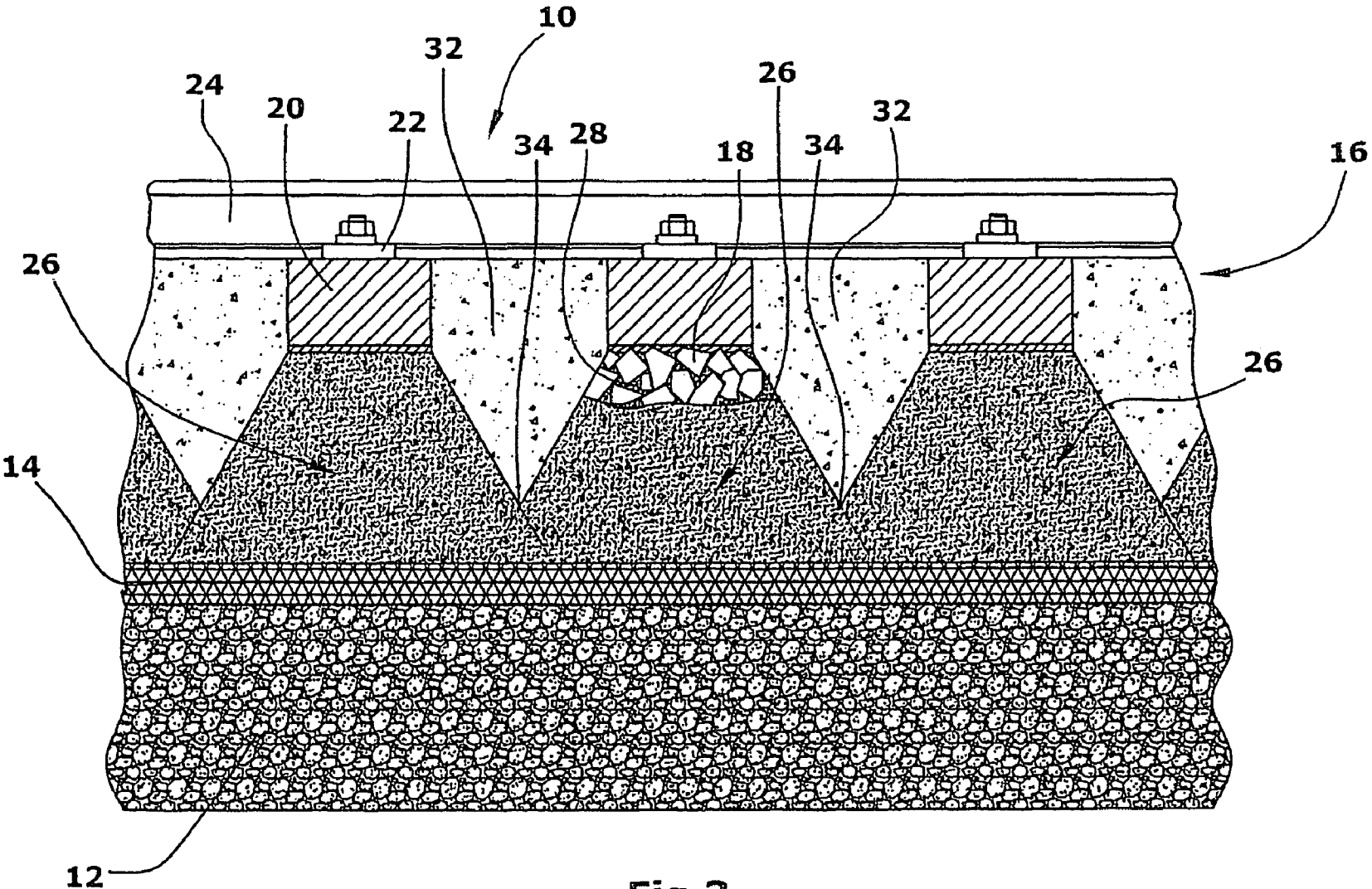
Figure 4:
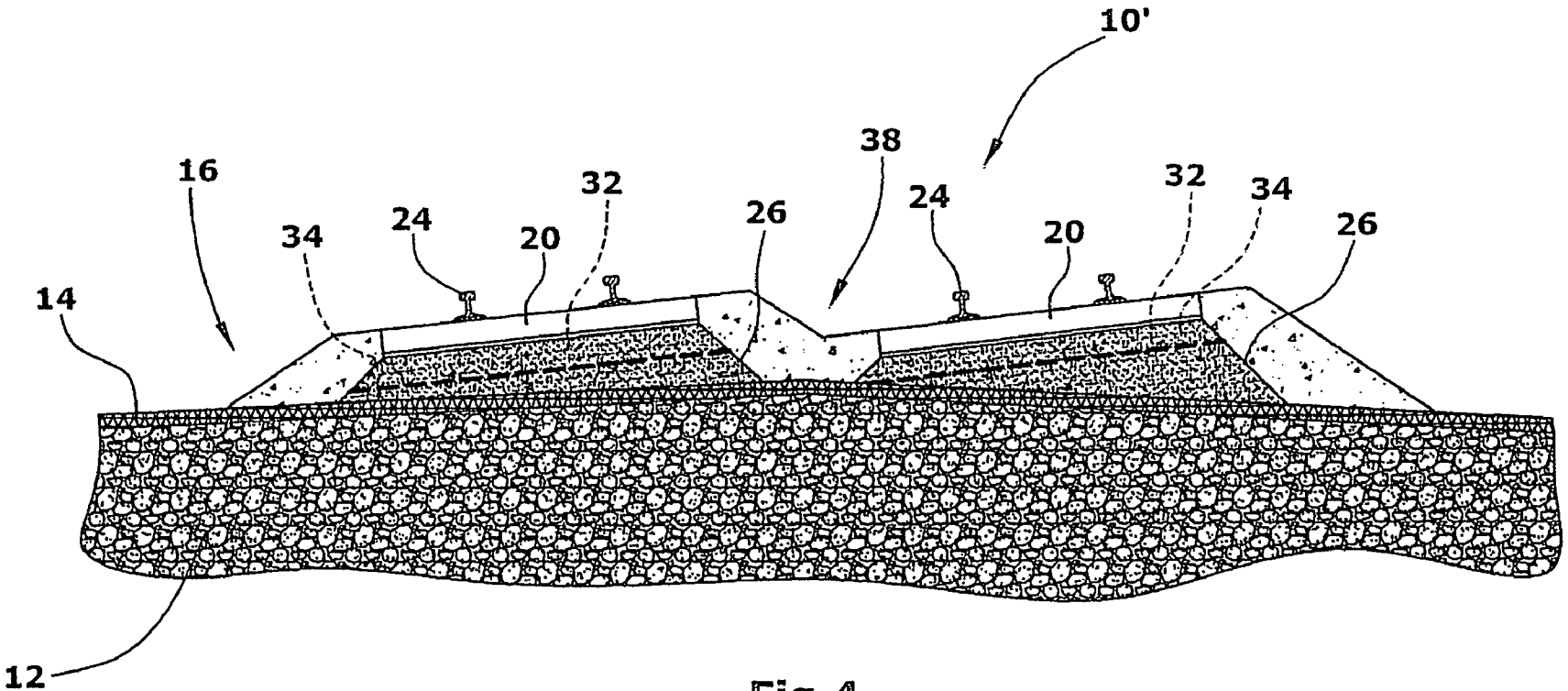

The invention will now be explained in detail with reference to the drawings. In the Figures:

FIG. 1 is a vertical section through a track superstructure according to the present invention, intended for a one-track line section, FIG. 2 is a top plan view on the track superstructure of FIG. 1, FIG. 3 is a vertical longitudinal section through a track superstructure according to the invention, intended for a one-track line section, and FIG. 4 is a vertical section through a track superstructure according to the invention, intended for a two-track line section.

FIGS. 1 to 3 illustrate a first embodiment of the present track superstructure. The track superstructure is situated on a subgrade or level ground 12 that is inclined as usual and may have a protective layer of asphalt or gravel. A drain mat 14 lies on the subgrade 12 (level), on which a ballast bed 16 of individual ballast stones 18 (indicated in FIGS. 1 and 2 and shown in detail in FIG. 3) is applied. Sleepers 20 (of wood, concrete or steel) are embedded in the top portion of the ballast bed 16, to which the rails 24 are mounted by means of especially vertically adjustable fastening points (indicated at 22).

Starting from the sleepers 20, the load dissipation regions 26 are defined in the ballast bed 16, within which the loads introduced during the passage of a train over the rails 24 are transferred to the subgrade 12.

In the section of FIG. 3, these load dissipation regions 26 are of trapezoidal shape. In the end portion of the ballast bed 16 facing the subgrade 12, the load dissipation regions 26 merge. In top plan view, the load dissipation region 26 is as illustrated in FIG. 2. The regions between adjacent load dissipation regions 26 are substantially V-shaped.

Prior to the start-up of the track superstructure 10, the ballast bed 16 is compacted and vibrated to cause a first subsiding.

According to the invention, the voids between the ballast stones 18 are now completely filled with foam within the load dissipation regions 26, preferably with a PU foam 28 adjusted according to the requirements and loads. Regarding the pressure resistance, adhesion and foaming behavior, PU foams may be adapted to the respective requirements, as known per se, resulting in a foam material optimized for the respective application. The ballast stones 18 within the load dissipation regions 26 are thus fixed in position; the sleepers 20 have footings 30 of (elastic) plastic material on their underside. The foam may also be provided laterally of the lower portion of the sleepers 20 so that these are embedded in ballast bed portions provided with foam 28.

As is obvious especially in FIG. 3, in the present track superstructure 10, the regions 32 of the ballast bed 16 between the load dissipation regions 26 remain free of foam so that precipitation can flow off transversely through the track superstructure 10. By providing an, inclination along the interface between two adjacent load dissipation regions 26, indicated at 34 in FIG. 3, which forms the base of a zone 32, this drainage is further enhanced. Precipitation falling on the ballast bed 16 on the sides of the track outside the load dissipation regions 26 (as indicated at 34 in FIG. 1) or precipitation accumulated at the side of the ballast bed 16 will be discharged via the drain mat 14 below the track superstructure 10.

The benefit of a drain mat 14 below the track superstructure becomes particularly obvious with line of two or more tracks, as illustrated in FIG. 4. As far as the individual elements of the track superstructure 10' of FIG. 4 are identical or similar to the elements of the track superstructure 10 of FIGS. 1 to 3, they bear the same reference numerals in FIG. 4.

Precipitation accumulating within the zones 34 of the right part of the ballast bed 16 in FIG. 4 flows off to the center 38 of the ballast bed 16, from where it is drained via the left part of the drain mat 14 in FIG. 4 under the left track in FIG. 4.

The following device, for example, is suitable for introducing the foam into the ballast bed:

The foam is introduced into an existing or newly built track system using a device mounted on a railway vehicle. This device comprises the following sections:

a traction vehicle a supply for each respective tank holding the components of the foam a supply for fuel used to heat and dry the track system a heating and drying unit, pressurized air supply a foam applicator.

The traction vehicle may be a vehicle allowing for a step operation and a displacement of <1 m/sec, whereby the unit can be positioned inch-perfect.

The supplies are equipped with KTCs that may be filled in the plant and may be positioned on and taken off the unit with a crane.

The heating and drying unit preferably comprises a bell of at least 6×2.5 m, for example, which may be lowered and into which hot air from a support burner, for example, is supplied by blowers via air conduits. Several such units (e.g. three) may be arranged in series to set the necessary parameters of the foaming depending on the outside temperature and the humidity of the ballast. The heating may be effected using petrol products, gas or natural vegetable oils. The exhaust gas heat and the waste heat of the traction vehicle could also be used. The warm air saturated with humidity exits from the sides of the track system.

The foam is introduced into the heated and dried ballast. To this end, a device is used, for example, that has up to eight foam lances per sleeper side and can serve a plurality of sleepers, e.g. ten, at the same time. The foam lances may be lowered individually into the ballast bed by means of a driving means. The necessary amount of lowering is calculated for each lance by a process computer after determination of the inclination of the track system. The lances may be closed at their lower end and may have lateral outlet nozzles of equal or different opening diameters. Within the device, the lances may be displaced by lateral drives and are positioned immediately beside the sleeper through measuring means. After the lances have been lowered to the calculated point, the foaming process controlled process computer is initiated. In this process, pumps for each lance pump the calculated amounts of components into the mixing head at the top of the lance, where they are mixed and are subsequently pressed into the ballast bed. At the same time, a drive pulls the lances from the ballast bed at a speed previously calculated and controlled by the process computer. The computer detects the end of the foaming process and turns the pumps off or closes the valves at the mixing head. The lance is at once blown free using pressurized air and rinsed with hot water and blown dry again with pressurized air.

After this cycle, the device is raised together with the heating bells. During the displacement of the device, the heating of the air and the blowers are switched off. The train may then be displaced to repeat the procedure at the next segment.

The lances are removably mounted to a part that receives the drive, acting as a support for the vertical insertion into the ballast bed. The mixing head is mounted thereon. The lower part of the lance is made from a wear-resistant material such as tungsten carbide or a corresponding steel.

The invention claimed is:

1. A track superstructure for a railway on a subgrade inclined transversely to a length of the track superstructure, the track superstructure comprising:

a ballast structure of individual ballast stones, and sleepers embedded in the ballast structure, wherein rails may be mounted on the sleepers, the ballast structure comprising load dissipation regions beneath the sleepers, said regions receiving loads acting vertically on the ballast structure via said sleepers when a train rides on the rails and transferring these loads to the subgrade below the ballast structure, wherein said load dissipation regions extend from beneath the sleepers into the ballast structure and toward the subgrade, the load dissipation regions being positioned between a bottom surface of the sleepers and the subgrade, the load dissipation regions laterally widen with increasing depth toward the subgrade, and wherein all regions of the ballast structure located adjacent a top surface of the load dissipation regions and between the sleepers are outside of the load dissipation regions, and only voids between the ballast stones within the load dissipation regions of the ballast structure are filled with a foam material for fixing the ballast stones in a stable position.

2. The track superstructure of claim 1, characterized in that the bottom faces of the sleepers are provided with a footing of an elastic material.

3. The track superstructure of claim 2, wherein the elastic material comprises a plastic material.

4. The track superstructure of claim 1, further comprising the rails, wherein the rails are mounted to the sleepers so as to be vertically adjustable.

5. The track superstructure of claim 1, wherein the foam material comprises a polyurethane foam material.

6. The track superstructure of claim 1, further comprising an elastic drain layer arranged between the ballast structure and the subgrade.

7. The track superstructure of claim 6, wherein the elastic drain layer comprises a porous layer of interconnected particles of elastomer material.

8. The track superstructure of claim 6, further comprising a non-woven material that is provided at least one of above or beneath the elastic drain layer.

9. The track superstructure of claim 6, wherein the elastic drain layer comprises rubber particles.

10. The track superstructure of claim 9, wherein the rubber particles comprise recycled tires.

11. A method for making a track superstructure for a railway on a subgrade inclined transversely to the length thereof, the method comprising:

forming a ballast structure of individual ballast stones having voids between the ballast stones on a subgrade;

embedding sleepers into the ballast structure;

fastening rails on the sleepers; and introducing a foamable material into the voids between the ballast stones to fix the stones in a stable position, the foamable material being introduced into only the voids between ballast stones present within load dissipation regions of the ballast structure beneath the sleepers, wherein the load dissipation regions extend from beneath the sleepers into the ballast structure and toward the subgrade, the load dissipation regions being positioned between a bottom surface of the sleepers and the subgrade, and wherein all regions of the ballast structure located adjacent a top surface of the load dissipation regions and between the sleepers are outside of the load dissipation regions.

12. The method for making a track superstructure of claim 11, further comprising washing the ballast stones before the ballast structure is built or before the foamable material is introduced into the ballast structure.

13. The method for making a track superstructure of claim 12, wherein washing the ballast stones comprises washing the ballast stones before the ballast structure is built and before the foamable material is introduced into the ballast structure.

14. The method for making a track superstructure of claim 11, further comprising heating the ballast structure prior to the introduction of the foamable material.

15. The method for making a track superstructure of claim 11, wherein embedding the sleepers comprises embedding sleepers with a footing of an elastic material.

16. The method for making a track superstructure of claim 15, wherein the elastic material comprises a plastic material.

17. The method for making a track superstructure of claim 11, further comprising at least one of compacting or vibrating the ballast structure to cause a first subsiding prior to the introduction of the foamable material.

18. The method for making a track superstructure of claim 17, characterized in that the ballast structure is compacted and vibrated to cause a first subsiding prior to the introduction of the foamable material.

19. The method for making a track superstructure of claim 11, further comprising arranging an elastic drain mat on the subgrade between the ballast structure and the subgrade.

20. A multi-track superstructure for a railway on a subgrade inclined transversely to a length of the multi-track superstructure, the multi-track superstructure comprising:

a ballast structure of individual ballast stones, and sleepers for two or more tracks embedded in the ballast structure, wherein rails for said two or more tracks may be mounted on the sleepers, the ballast structure comprising load dissipation regions beneath the sleepers, said regions receiving loads acting vertically on the ballast structure via said sleepers when a train rides on the rails and transferring these loads to the subgrade below the ballast structure, wherein the load dissipation regions extend from beneath the sleepers into the ballast structure and toward the subgrade, the load dissipation regions being positioned between a bottom surface of the sleepers and the subgrade, the load dissipation regions laterally widen with increasing depth toward the subgrade, and wherein all regions of the ballast structure located adjacent a top surface of the load dissipation regions and between the sleepers are outside of the load dissipation regions, and only voids between the ballast stones within the load dissipation regions of the ballast structure are filled with a foam material for fixing the ballast stones in a stable position, and an elastic drain layer is arranged between the ballast structure and the subgrade.

* * * * *